US006343674B1

(12) United States Patent
Sexsmith

(10) Patent No.: US 6,343,674 B1
(45) Date of Patent: Feb. 5, 2002

(54) MULTI-TERRAIN VERTICAL LIFT TRANSPORTER

(76) Inventor: Hugh Sexsmith, 48508 Ryder Lake Road, Chilliwack, British Columbia (CA), V4Z 1E3

( * ) Notice: Subject to any disclaimer, the term of this patent is extended or adjusted under 35 U.S.C. 154(b) by 0 days.

(21) Appl. No.: 09/497,258

(22) Filed: Feb. 3, 2000

(30) Foreign Application Priority Data

Mar. 3, 1999 (CA) ..... 2264368

(51) Int. Cl.[7] ..... B66F 9/06; B66F 09/22

(52) U.S. Cl. ..... 187/222; 187/231; 187/232; 187/234; 187/237; 187/244; 180/19.2; 414/460

(58) Field of Search ..... 187/222, 229, 187/231–234, 237, 240, 244, 272, 274; 414/460, 24.5; 180/19.1, 19.2; 280/62, 47.34, 638, 35

(56) References Cited

U.S. PATENT DOCUMENTS 2,846,018 A * 8/1958 Puckett ..... 187/237 X
2,875,852 A * 3/1959 Morrell ..... 187/237 X
2,899,093 A * 8/1959 Morrell ..... 187/237 X
2,925,887 A * 2/1960 Gibson ..... 187/232
3,090,459 A * 5/1963 Scudder ..... 180/19.2
3,356,241 A * 12/1967 Varilek ..... 414/671
3,485,391 A * 12/1969 Johns ..... 187/231 X
3,529,736 A * 9/1970 Lebre ..... 414/458
3,616,953 A * 11/1971 Shaffer et al. ..... 414/631
3,957,137 A 5/1976 Vermette
4,124,101 A * 11/1978 Yarris ..... 187/238 X
4,521,149 A * 6/1985 Redding et al. ..... 414/458 X
4,529,063 A * 7/1985 Kishi ..... 187/232 X
4,571,139 A 2/1986 Moseley et al.
4,655,670 A * 4/1987 Hogberg et al. ..... 414/458
4,940,381 A * 7/1990 Rysewyk ..... 187/244 X
4,987,976 A 1/1991 Daugherty
4,999,902 A * 3/1991 Schumacher et al. ... 187/238 X
5,046,585 A * 9/1991 Ohta et al. ..... 187/238 X
5,147,170 A 9/1992 Detrick
5,174,415 A 12/1992 Neagle et al.
5,584,363 A 12/1996 Curtin et al.
5,586,620 A * 12/1996 Dammeyer et al. ..... 187/227
5,618,154 A 4/1997 Irons, Jr. et al.
5,788,452 A * 8/1998 Brouwer et al. ..... 187/222 X

FOREIGN PATENT DOCUMENTS

DE 1252588 A * 10/1967 ..... 187/232
GB 1206319 A * 9/1970 ..... 187/232

* cited by examiner

*Primary Examiner*—Dean J. Kramer
*Assistant Examiner*—Thuy V. Tran
(74) *Attorney, Agent, or Firm*—Hall, Priddy, Myers & Vande Sande

(57) ABSTRACT

A multi-terrain vertical lift transporter for lifting and transporting loads over various soil conditions and terrain. The lift transporter has a laterally adjustable wheel base to allow it to accommodate loads of varying widths. Further, the lift transporter does not require a counter-weight as the center of gravity of the load is substantially within the wheel base.

7 Claims, 3 Drawing Sheets

MULTI-TERRAIN VERTICAL LIFT TRANSPORTER

FIELD

This invention relates to a self-propelled multi-terrain vertical lift transporter for lifting and transporting loads over various soil conditions and terrain.

BACKGROUND OF THE INVENTION

Forklift trucks are widely used in a variety of applications and come in many different shapes and sizes. In particular, many forklifts have been designed especially for light duty applications. However, these light duty forklifts typically have a fixed wheel base making it difficult to use them in narrow passageways and at the same time lack the requisite stability to avoid tipping or overturning in response to unbalanced loads or encountering variable terrain.

U.S. Pat. No. 4,571,139 issued Feb. 18, 1986 to Moseley et al. discloses a freight handling truck comprising a frame mounted on at least three wheels, a supporting mast, lifting forks and a motor. Of the three wheels, at least one is a driving wheel powered by the motor and the other two wheels are idler wheels, mounted on two horizontally pivotal wheel arms. The pivotal wheel arms are powered by the motor to pivot them laterally to either widen or narrow their lateral extent. The pivotal wheel arms are also telescopic, allowing them to extend or retract. In the freight handling truck disclosed by Moseley et al. the wheels mounted at the ends of the adjustable wheel arms are not capable of pivoting or re-orienting as the wheel arms pivot. Therefore, the wheels mounted on the adjustable wheel arms are parallel with the path of travel of the device for only one angle of the wheel arms. Thus increased friction occurs when the angle of the wheel arms is changed to different angles. Also, the freight handling truck, as disclosed by Moseley et al., cannot lower a load to the floor if the pivotal wheel arms are in the narrowed position. The freight handling truck disclosed by Moseley et al. is further limited in that it is incapable of performing a tight radius turn.

It is, therefore, an object of this invention to provide a lift transporter with improved stability and maneuverability.

It is a further object of this invention to provided a lift transporter which is capable of laterally adjusting its wheel base.

It is a further object of this invention to provide a lift transporter capable of performing a tight radius turn.

It is a further object of this invention to provide a lift transporter which is reduced in weight.

SUMMARY OF THE INVENTION

The lift transporter of this invention is constructed of a steel frame which houses a motor and the hydraulic systems. Four wheels, two front and two rear, are mounted onto the frame. The two front wheels are mounted on laterally adjustable outriggers which are arranged outside of the lifting forks. The separation of the laterally adjustable outriggers, through the operation of the hydraulic systems, can be widened or narrowed as required. The two rear wheels are mounted on a common axle which is journaled to a post. Thus, the rear wheels are locked together for improved traction and are hydraulically powered. The front and rear wheels are of a sufficient width and tread design to allow the lift transporter to move over various terrain including gravel, sand and mud.

The lift platform of the lift transporter may consist of lifting forks, or other lifting implements, all of which can be interchanged simply by lifting one implement off of the horizontal members of the lift carriage and replacing it with another implement. The lift carriage is hydraulically powered to be raised and lowered.

The lift transporter is steered utilizing a tiller handle. Mounted to the neck of the tiller handle are the controls for raising and lowering the lift assembly, moving the lift transporter forward and reverse, and widening and narrowing the laterally adjustable outriggers. Also, the tiller handle and the rear wheel assembly are constructed to pivot through a wide range thereby allowing the lift transporter to perform tight radius turns.

The improved lift transporter of this invention does not require a counter weight as the center of gravity of any load is substantially within the wheels and thus cannot tip the unit.

Other objects and advantages of the invention will become clear from the following detailed description of the preferred embodiment, which is presented by way of illustration only and without limiting the scope of the invention to the details thereof.

BRIEF DESCRIPTION OF THE DRAWINGS

The invention itself both as to organization and method of operation, as well as additional objects and advantages thereof, will become readily apparent from the following detailed description when read in connection with the accompanying drawings, wherein.

DETAILED DESCRIPTION OF THE INVENTION

Figure 1:
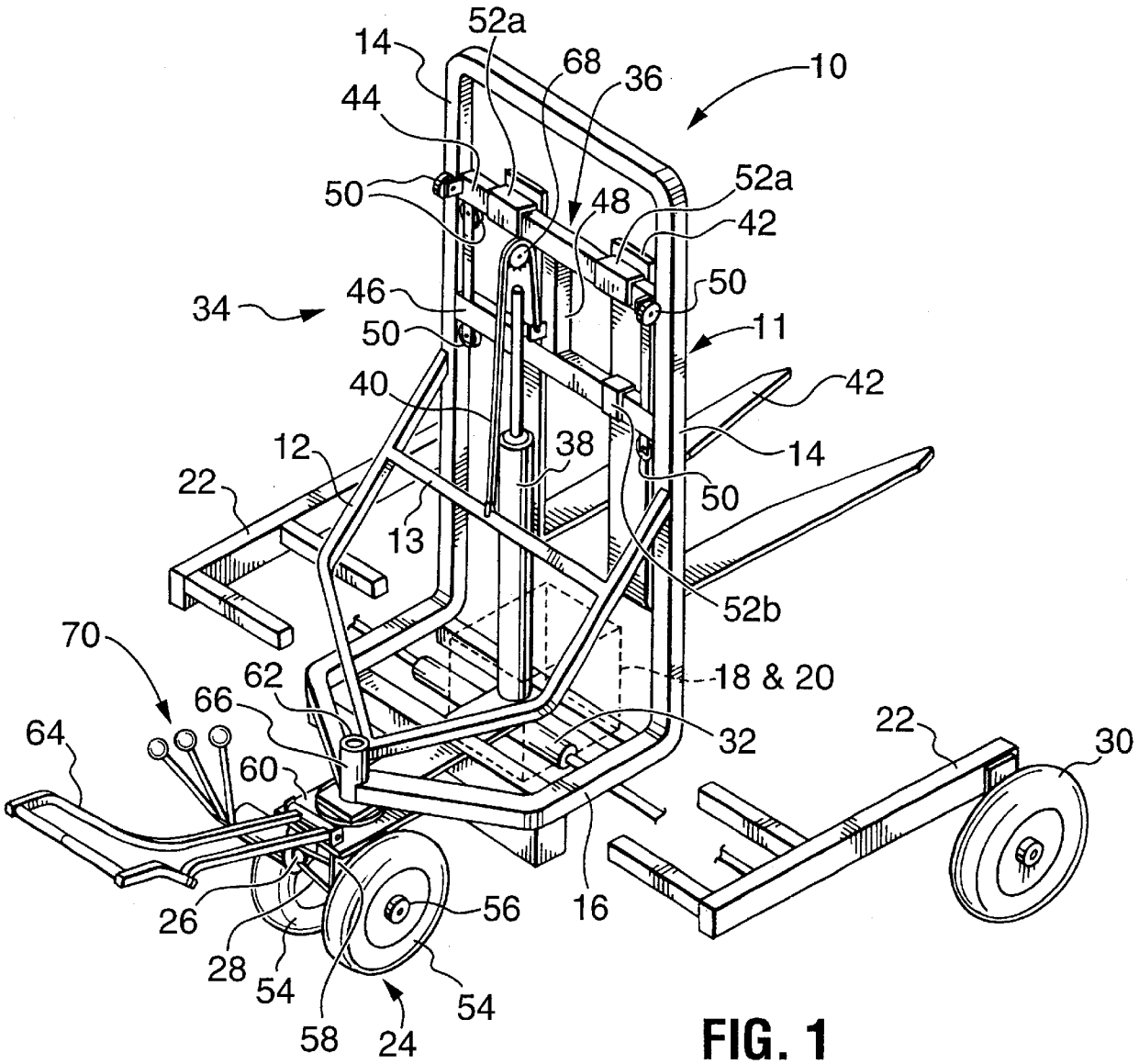
FIG. 1 is a perspective view of the lift transporter with lifting forks as the lift platform.
Figure 2:
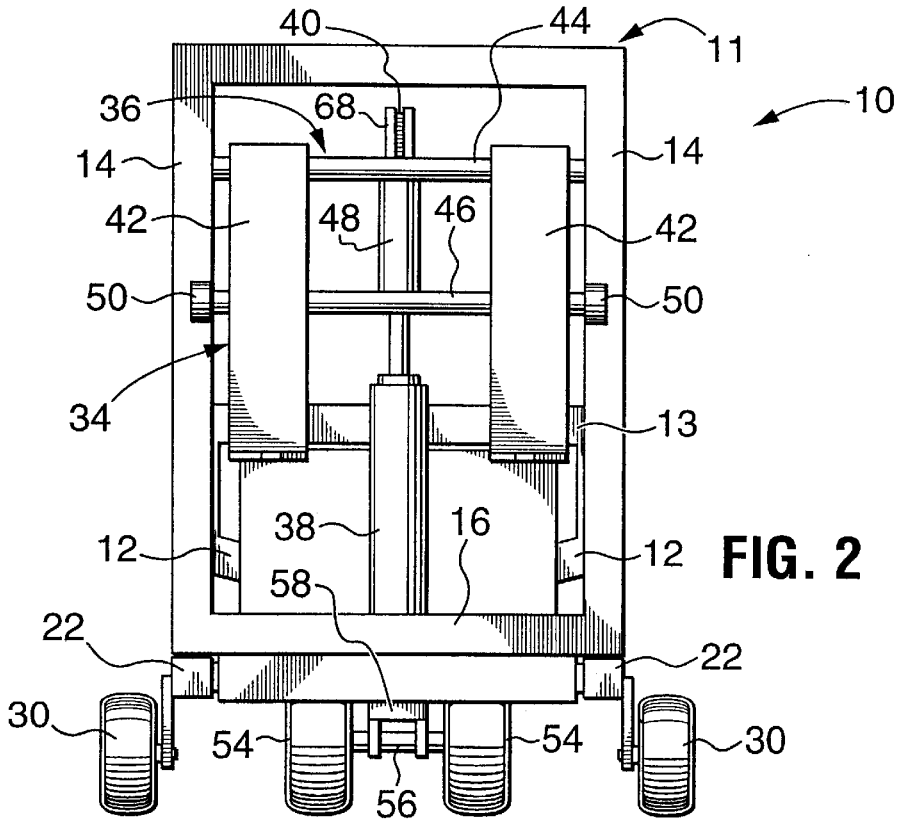
FIG. 2 is a front view of the lift transporter with the outriggers in a narrowed position.
Figure 3:
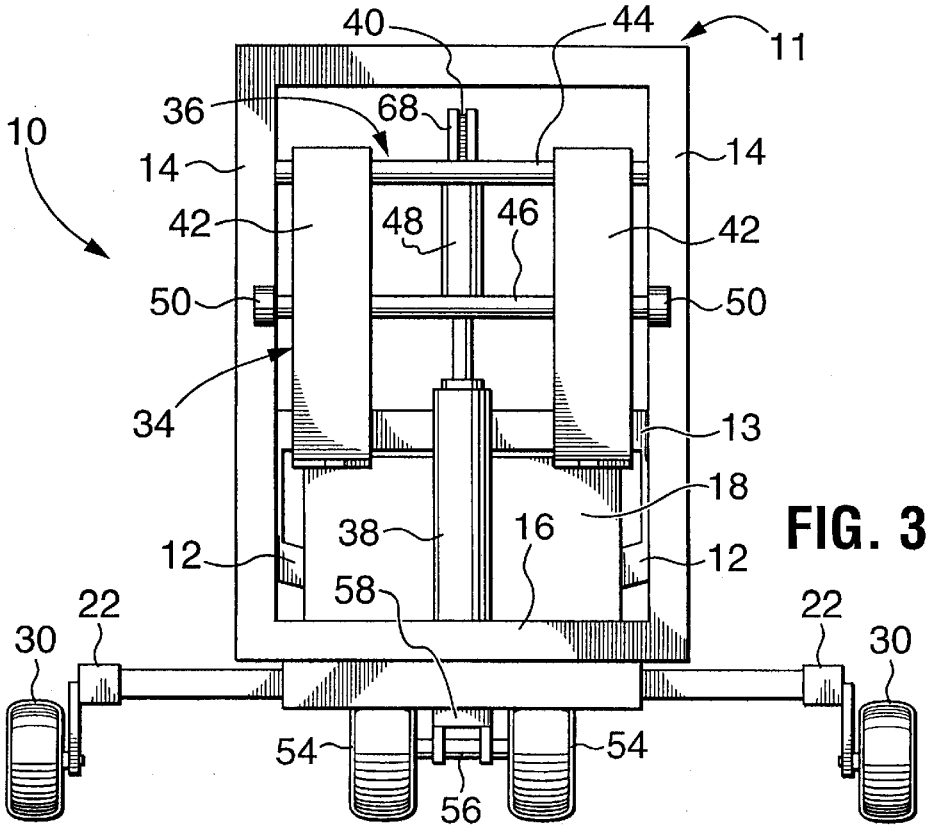
FIG. 3 is a front view of the lift transporter with the outriggers in a widened position.
Figure 4:
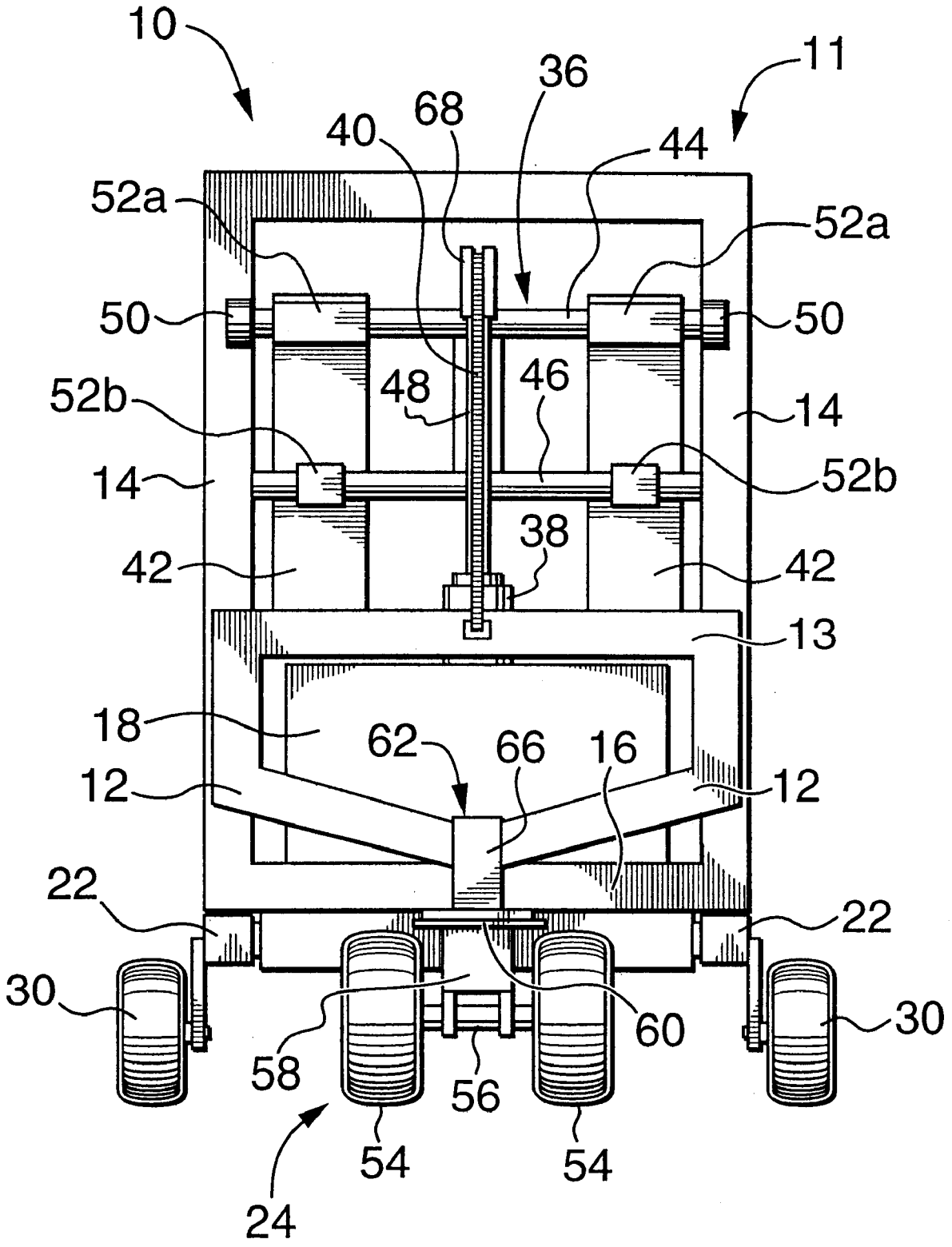
FIG. 4 is a rear view of the lift transporter with the outriggers in a narrowed position and the tiller handle has been removed for clarity.

Throughout the figures, like elements are indicated by like reference numbers. Referring to FIGS. 1 to 4, the lift transporter 10 includes a frame 11 which houses a motor 18 and the hydraulic systems (not shown). Frame 11 is comprised of vertical support portions 12, horizontal support portion 13, mast portions 14 and base portion 16. Slidably mounted to the underside of base portion 16 of frame 11 are laterally adjustable outriggers 22. The rear wheel assembly 24 is pivotally mounted to the rear of base portion 16 of frame 11.

The rear wheel assembly 24 comprises rear wheels 54, wheel axle 56, wheel post 58, tiller plate 60, tiller post 62 and tiller handle 64. The rear wheels 54 are mounted on a common wheel axle 56 which is operatively coupled to the wheel post 58. The wheel post 58 is mounted to the lower surface of the tiller plate 60. The tiller post 62 is mounted on the upper surface of tiller plate 60. The tiller post 62 is received in post receptacle 66 located at the rear junction of the base portions 16 of the frame 11. The tiller post 62 is pivotally secured in the post receptacle 66 to allow the rear wheel assembly 24 to rotate about tiller post 62. The tiller handle 64 is mounted on the upper surface of tiller plate 60 such that the rear wheels 54 and the tiller handle 64 are parallel. The control levers 70 are mounted on the neck of the tiller handle 64. The control levers 70 operate to actuate the various cylinders that are used in the operation of the lift transporter 10. The rear wheels 54 are operatively coupled to motor 18 by any suitable power transmission means.

Mounted at the distal ends of the laterally adjustable outriggers 22 are the idler wheels 30. The idler wheels 30 are preferably mounted on a fixed axis and so do not turn to either side. The laterally adjustable outriggers 22 are operatively coupled to the hydraulic cylinder 32. Hydraulic cylinder 32 operates to widen and narrow the laterally adjustable outriggers 22.

The lift assembly 34 comprises the lift carriage 36, hydraulic cylinder 38, chain 40, rotatable sprocket 68 and lift implement 42. The lift carriage 36 is I-shaped with upper horizontal member 44, lower horizontal member 46 and vertical member 48 being mounted between the upper and lower horizontal members 44 and 46. The lift carriage 36 is slidably mounted to mast portions 14 of frame 11. Mounted on the ends of horizontal members 44 and 46 are front and rear guide rollers 50 which engage mast portions 14. Rollers (not shown) which are mounted inside each end of the upper and lower horizontal members 44 and 46, protrude slightly to roll over the inside of the mast portions 14. A rotatable sprocket 68 is mounted to the top of hydraulic cylinder 38 with a chain 40 engaging the rotatable sprocket 68. One end of chain 40 is secured to the vertical member 48 of the lift carriage 36, and the other end of chain 40 is secured to the horizontal support portion 13 of frame 11. Thus, the lift carriage 36 is raised and lowered through the operation of hydraulic cylinder 38.

The lift implement 42 is detachably secured to the horizontal members 44 and 46 of the lift carriage 36 by upper and lower hook braces 52*a* and 52*b*. The lift implement 42 may take on a variety of forms, including, but not limited to forks, a bucket and a large planar surface. A lift implement of one form may be substituted for a lift implement of another form by lifting hook braces 52*a* and 52*b*of lift implement 42 from horizontal members 44 and 46, respectively, and placing the hook braces of an alternate lift implement onto horizontal members 44 and 46.

The motor 18 is sufficiently powerful to drive either the rear wheels 54 while under a load of about 500 lbs, the hydraulic systems (not shown) to operate the laterally adjustable outriggers 22 to widen or narrow them when the lift transporter 10 is under a load of about 500 lbs, or the hydraulic systems to allow the lift transporter 10 to raise a load of about 500 lbs.

In operation, a user steers the lift transporter 10 through tiller handle 64. Tiller handle 64 can be pivoted in the horizontal plane parallel to the ground through a range of about 220°. A user utilizes control levers 70 to actuate the various hydraulic cylinders necessary to operate the lift transporter 10. Hydraulic cylinder 38 is actuated to raise and lower the lift carriage 36 and hydraulic cylinder 32 is actuated to widen and narrow the laterally adjustable outriggers 22. The control levers 70 also regulate the speed and direction of the lift transporter 10 when engaging the power transmission means of the rear wheels 54. The control levers 70 are designed such that only one of the rear wheel assembly 24, the laterally adjustable outriggers 22 or the lift assembly 34, may be in operation at one time.

To lift a load, the lift transporter 10 is directed using tiller handle 64. The rear wheels 54 are engaged, through the control levers 70, to propel the lift transporter 10 to the target location. At any point, the rear wheels 54 may be disengaged and the laterally adjustable outriggers 22 may be widened or narrowed. The laterally adjustable outriggers 22 may be narrowed to accommodate a narrow load or pass through a narrow space, or the laterally adjustable outriggers 22 may be widened to accommodate a wider load. The adjustment of the laterally adjustable outriggers is effected through the actuation of hydraulic cylinder 32 through the control levers 70. Once the lift implement 42 has been positioned under the load, the user utilizes control levers 70 to raise the load. Hydraulic cylinder 38 is actuated to extend its piston, thereby raising the lift carriage 36 to which the lift implement 42 is detachably secured. When the load has been raised to the appropriate height, the laterally adjustable outriggers 22 may be adjusted once again. The load on the lift implement 42 is within the wheel base of the lift transporter 10, preventing tipping of the lift transporter 10 by an imbalance in the load.

It will be appreciated by those skilled in the art that the lift transporter of this invention is distinguished by its versatility, simplicity, and efficiency. Moreover, the design of the lift transporter precludes the need for a counter-weight thereby decreasing the weight of the lift transporter making it easier to maneuver and control.

Furthermore, it will be understood that the motor, hydraulic cylinders, hydraulic systems, etc. used throughout this invention may be of any desired design according to the knowledge of those skilled in the art and operate in conventional fashion to achieve the intended result. Indeed, the hydraulic cylinders, may be replaced with electric or pneumatic equipment, if so desired.

Although the present invention has been described in detail with reference to one preferred embodiment, it will be clearly understood that this is by way of illustration only. Many variations and alternative embodiments of the invention will now be apparent to those skilled in the art, and are not to be excluded from the scope of the invention, which is to be determined only by the appended claims, as set forth below.

What is claimed is:

1. A lift transporter for lifting and transporting loads, comprising:

(a) a frame;

(b) a lift assembly coupled to said frame so as to be reversibly moveable, vertically from a lowered position on a lift transporter support surface to an elevated position;

(c) a plurality of guide rollers mounted on one of said lift assembly and frame and contacting another of said lift assembly and frame, providing opposed forces against said lift assembly in two substantially orthogonal directions so as to prevent said lift assembly from contacting said frame when said lift transporter is on a sloped surface;

(d) a load engaging implement coupled to said lift assembly and operative to raise and lower a load in response to raising and lowering of said lift assembly;

(e) a pair of idler wheels and an outrigger assembly, one of said pair journaled to each side of said outrigger assembly proximate a front thereof and extending out from each side of said frame, said outrigger assembly reversibly slideable, outwardly so as to widen a selected amount in response to actuation of a control;

(f) a pair of rear wheels pivotally coupled to said frame on either side of a center of said transporter proximate a rear thereof, said pair of rear wheels being locked together in rotation to provide increased traction;

(g) a motor coupled to said frame operative to drive said rear wheels in tandem so as to move said lift transporter and to power said lift assembly and to retract and extend said outrigger assembly;

wherein said load engaging implement lies substantially within an area bounded by lines joining said idler wheels.

2. The lift transporter according to claim 1, wherein said load engaging implement includes a pair of forks with each fork having an angled outer edge at a distal end thereof so as to center a load and an inner angled edge to counter a tendency for the angled outer edge to move sideways.

3. The lift transporter according to claim 1, wherein said load engaging implement is removably, detachably secured to said lift assembly.

4. The lift transporter according to claim 3, wherein said load engaging implement includes a pair of forks and has been said pair of forks each have a pair of spaced apart brackets which detachably engage a pair of spaced apart horizontal bars of said lift assembly.

5. The lift transporter according to claim 1, including a tiller coupled to said rear wheels so as to cause said rear wheels to turn relative to said frame and turn said lift transporter.

6. The lift transporter according to claim 1, wherein said motor is a hydraulic motor operative to drive a first hydraulic piston cylinder for raising and lowering said lift assembly and a second hydraulic piston cylinder for retracting and extending said outrigger assembly said outriggers.

7. The lift transporter according to claim 1, wherein said guide rollers are a plurality of idler wheels rotationally mounted on said lift assembly.

* * * * *

UNITED STATES PATENT AND TRADEMARK OFFICE

CERTIFICATE OF CORRECTION

PATENT NO. : 6,343,674 B1
DATED : February 5, 2002
INVENTOR(S) : Hugh Sexsmith

It is certified that error appears in the above-identified patent and that said Letters Patent is hereby corrected as shown below:

Column 5,
Lines 15-16, delete “has been”.

Signed and Sealed this

Twenty-fifth Day of February, 2003

JAMES E. ROGAN
*Director of the United States Patent and Trademark Office*